US008413709B2

(12) United States Patent
Lee et al.

(10) Patent No.: US 8,413,709 B2
(45) Date of Patent: Apr. 9, 2013

(54) COMPOSITE CORE DIE, METHODS OF MANUFACTURE THEREOF AND ARTICLES MANUFACTURED THEREFROM

(75) Inventors: Ching-Pang Lee, Cincinnati, OH (US); Hsin-Pang Wang, Rexford, NY (US); Ram Kumar Upadhyay, Niskayuna, NY (US); Paul Richard Myers, Clifton Park, NY (US); Marc Thomas Edgar, Glenmont, NY (US); Thomas Donald Martyn, Cincinnati, OH (US); Eric Alan Estill, Morrow, OH (US)

(73) Assignee: General Electric Company, Schenectady, NY (US)

( * ) Notice: Subject to any disclaimer, the term of this patent is extended or adjusted under 35 U.S.C. 154(b) by 260 days.

(21) Appl. No.: 11/567,477

(22) Filed: Dec. 6, 2006

(65) Prior Publication Data

US 2008/0135202 A1 Jun. 12, 2008

(51) Int. Cl.
*B22C 9/00* (2006.01)
*B22C 9/10* (2006.01)

(52) U.S. Cl.
USPC ..... 164/361; 164/369

(58) Field of Classification Search ..... 164/28, 164/228, 516, 34, 35, 361, 369
See application file for complete search history.

(56) References Cited

U.S. PATENT DOCUMENTS 3,220,972 A 11/1965 Lamoreaux
3,516,946 A 6/1970 Modic
3,715,334 A 2/1973 Karstedt
3,775,452 A 11/1973 Karstedt
4,288,345 A 9/1981 Ashby et al.
4,323,756 A 4/1982 Brown et al.
4,421,153 A * 12/1983 Wilkinson et al. ..... 164/35
4,421,903 A 12/1983 Ashby
4,617,977 A * 10/1986 Mills ..... 164/30
4,724,299 A 2/1988 Hammeke
4,730,093 A 3/1988 Mehta et al.
4,922,991 A 5/1990 Pitcher et al.
5,014,763 A 5/1991 Frank
5,038,014 A 8/1991 Pratt et al.
5,043,548 A 8/1991 Whitney et al.
5,337,568 A 8/1994 Lee et al.
5,397,215 A 3/1995 Spear et al.

(Continued)

FOREIGN PATENT DOCUMENTS

GB 2090181 A 6/1978
GB 2096523 A 3/1981

OTHER PUBLICATIONS

Harvey et al; Non-Axisymmetric Turbine End Wall Design: Part 1 Three-Dimensional Linear Design System; ASME Paper; 99-GT-337; Presented at the International Gas Turbine & Aeroengine Congress & Exhibition, Indianapolis, Indiana; 8 pages; Jun. 7-Jun. 10, (1999 ).

Krauss et al; "Rheological Properties of Alumina Injection Feedstocks"; Materials Research; 8; pp. 187-189; (2005).

(Continued)

*Primary Examiner* — Kevin P Kerns
(74) *Attorney, Agent, or Firm* — Cantor Colburn LLP

(57) ABSTRACT

A composite core die includes a reusable core die and a disposable core die; where the disposable core die is in physical communication with the reusable core die; and further where surfaces of communication between the disposable core die and the reusable core die serve as barriers to prevent the leakage of a slurry that is disposed in the composite core die.

11 Claims, 6 Drawing Sheets

U.S. PATENT DOCUMENTS

| | | | | |
|---|---|---|---|---|
| 5,931,638 | A | 8/1999 | Krause et al. | |
| 6,017,186 | A | 1/2000 | Hoeger et al. | |
| 6,254,334 | B1 | 7/2001 | LaFleur | |
| 6,269,540 | B1 | 8/2001 | Islam et al. | |
| 6,283,713 | B1 | 9/2001 | Harvey et al. | |
| 6,338,609 | B1 | 1/2002 | Decker et al. | |
| 6,379,528 | B1 | 4/2002 | Lee et al. | |
| 6,402,464 | B1 | 6/2002 | Chiu et al. | |
| 6,419,446 | B1 | 7/2002 | Kvasnak et al. | |
| 6,429,402 | B1 | 8/2002 | Dixon et al. | |
| 6,478,073 | B1 * | 11/2002 | Grebe et al. | 164/369 |
| 6,502,622 | B2 | 1/2003 | Lee et al. | |
| 6,504,127 | B1 | 1/2003 | McGregor et al. | |
| 6,511,294 | B1 | 1/2003 | Mielke et al. | |
| 6,546,730 | B2 | 4/2003 | Johnson et al. | |
| 6,561,761 | B1 | 5/2003 | Decker et al. | |
| 6,578,623 | B2 * | 6/2003 | Keller et al. | 164/369 |
| 6,626,230 | B1 | 9/2003 | Woodrum et al. | |
| 6,669,445 | B2 | 12/2003 | Staubach et al. | |
| 6,974,308 | B2 | 12/2005 | Halfmann et al. | |
| 7,134,842 | B2 | 11/2006 | Tam et al. | |
| 2005/0006047 | A1 | 1/2005 | Wang et al. | |
| 2005/0070651 | A1 | 3/2005 | McNulty et al. | |
| 2005/0156361 | A1 | 7/2005 | Holowczak et al. | |
| 2005/0205232 | A1 | 9/2005 | Wang et al. | |
| 2006/0065383 | A1 | 3/2006 | Ortiz et al. | |
| 2006/0153681 | A1 | 7/2006 | Lee | |
| 2006/0233641 | A1 | 10/2006 | Lee et al. | |
| 2006/0275112 | A1 | 12/2006 | Lee et al. | |
| 2007/0003416 | A1 | 1/2007 | Bewlay et al. | |

OTHER PUBLICATIONS

Sieverding; "Secondary Flows in Straight and Annular Turbine Cascades"; in Thermodynamics and Fluid Mechanics of Turbomachinery, vol. II; Eds. A.S. Ucer, P. Stow, and Ch. Hirsch; NATO ASI Series; Martinus Nijhoff Publishers; pp. 621-664; (1985).

Shih et al; "Controlling Secondary-Flow Structure by Leading-Edge Airfoil Fillet and Inlet Swirl to Reduce Aerodynamic Loss and Surface Heat Transfer"; Transactions of the ASME; 125; pp. 48-56; Jan. (2003).

Takeishi et al; "An Experimental Study of the Heat Transfer and Film Cooling on Low Aspect Ratio Turbine Nozzles"; The American Society of Mechanical Engineers, 345 E. 47$^{th}$ St, New York, N.Y. 10017; ASME Paper 89-GT-187; Presented at the Gas Turbine and Aeroengine Congress and Exposition, Jun. 4-8, Toronto, Ontario Canada; 9 pages (1989).

Theiler, et al.; "Deposition of Graded Metal Matrix Composites by Laser Beam Cladding"; BIAS Bremen Institute of Applied Beam Technology, Germany; http://www.bias.de/WM/Publikationen/Deposition%20of%20graded.pdf; 10 pages; Jun. 2005.

U.S. Appl. No. 11/256,823, filed Oct. 24, 2005; "Ceramic-Based Molds for Industrial Gas Turbine Metal Castings Using Gelcasting"; Huang et al.

U.S. Appl. No. 11/540,741, filed Sep. 29, 2006; "Turbine Angel Wing Sealing Using Surface Depression Treatment"; Bunker, Ronald Scott.

U.S. Appl. No. 11/240,837, filed Sep. 30, 2006; "Methods for Making Ceramic Casting Cores and Related Articles and Processes"; H.P. Wang et al.

U.S. Appl. No. 11/567,409, filed Dec. 6, 2006; "Casting Compositions for Manufacturing Metal Castings and Methods of Manufacturing Thereof"; Hsin-Pang Wang et al.

U.S. Appl. No. 11/567,443, filed Dec. 6, 2006; "Disposable Insert, and Use Thereof in a Method for Manufacturing an Airfoil"; Ching-Pang Lee.

U.S. Appl. No. 11/567,521, filed Dec. 6, 2006; "Ceramic Cores, Methods of Manufacture Thereof and Articles Manufactured From the Same"; Chin-Pang Lee.

U.S. Appl. No. 11/635,749, filed Dec. 7, 2006; "Processes for the Formation of Positive Features on Shroud Components, and Related Articles"; Ching-Pang Lee.

U.S. Appl. No. 11/609,117, filed Dec. 11, 2006; "Disposable Thin Wall Core Die, Methods of Manufacture Thereof and Articles Manufactured Therefrom"; Hsin-Pang Wang et al.

U.S. Appl. No. 11/609,150, filed Dec. 11, 2006; "Method of Modifying the End Wall Contour in a Turbine Using Laser Consolidation and the Turbines Derived Therefrom" Ching-Pang et al.

European Search Report dated Oct. 26, 2009 for Application No. 07122380.4-2122/1930100.

* cited by examiner

COMPOSITE CORE DIE, METHODS OF MANUFACTURE THEREOF AND ARTICLES MANUFACTURED THEREFROM

BACKGROUND

This disclosure is related to composite disposable and reusable casting core dies.

Components having complex geometry, such as components having internal passages and voids therein, are difficult to cast using current commercial methods; tooling for such parts is both expensive and time consuming, for example, requiring a significant lead time. This situation is exacerbated by the nature of conventional molds comprising a shell and one or more separately formed cores, wherein the core(s) are prone to shift during casting, leading to low casting tolerances and low casting efficiency (yield). Examples of components having complex geometry and which are difficult to cast using conventional methods, include hollow airfoils for gas turbine engines, and in particular relatively small, double-walled airfoils. Examples of such airfoils for gas turbine engines include rotor blades and stator vanes of both turbine and compressor sections, or any parts that need internal cooling.

In current methods for casting hollow parts, a ceramic core and shell are produced separately. The ceramic core (for providing the hollow portions of the hollow part) is first manufactured by pouring a slurry that comprises a ceramic into a metal core die. After curing and firing, the slurry is solidified to form the ceramic core. The ceramic core is then encased in wax, and a ceramic shell is formed around the wax pattern. The wax that encases the ceramic core is then removed to form a ceramic mold. The ceramic mold is then used for casting metal parts. These current methods are expensive, have long lead-times, and have the disadvantage of low casting yields due to lack of reliable registration between the core and shell that permits movement of the core relative to the shell during the filling of the ceramic mold with molten metal. In the case of hollow airfoils, another disadvantage of such methods is that any holes that are desired in the casting are formed in an expensive, separate step after forming the cast part, for example, by electro-discharge machining (EDM) or laser drilling.

Development time and cost for airfoils are often increased because such components generally require several iterations, sometimes while the part is in production. To meet durability requirements, turbine airfoils are often designed with increased thickness and with increased cooling airflow capability in an attempt to compensate for poor casting tolerance, resulting in decreased engine efficiency and lower engine thrust. Improved methods for casting turbine airfoils will enable propulsion systems with greater range and greater durability, while providing improved airfoil cooling efficiency and greater dimensional stability.

Double wall construction and narrow secondary flow channels in modern airfoils add to the complexity of the already complex ceramic cores used in casting of turbine airfoils. Since the ceramic core identically matches the various internal voids in the airfoil which represent the various cooling channels and features it becomes correspondingly more complex as the cooling circuit increases in complexity. The double wall construction is difficult to manufacture because the core die cannot be used to form a complete integral ceramic core. Instead, the ceramic core is manufactured as multiple separate pieces and then assembled into the complete integral ceramic core. This method of manufacture is therefore a time consuming and low yielding process.

Accordingly, there is a need in the field to have an improved process that accurately produces the complete integral ceramic core for double wall airfoil casting.

SUMMARY

Disclosed herein is a composite core die comprising a reusable core die; and a disposable core die; wherein the disposable core die is in physical communication with the reusable core die; and further wherein surfaces of communication between the disposable core die and the reusable core die serve as barriers to prevent the leakage of a slurry that is disposed in the composite core die.

Disclosed herein too is a method comprising bringing a disposable core die into physical communication with a reusable core die to form a composite core die; wherein surfaces of communication between the disposable core die and the reusable core die serve as barriers to prevent the leakage of a slurry that is disposed in the composite core die; disposing a slurry comprising ceramic particles into the composite core die; curing the slurry to form a cured ceramic core; removing the disposable core die and the reusable core die from the cured ceramic core; and firing the cured ceramic core to form a solidified ceramic core.

BRIEF DESCRIPTION OF FIGURES

FIG. 1(*b*) depicts another exemplary embodiment of a composite die that can be used to manufacture a turbine airfoil;

DETAILED DESCRIPTION

Figure 1B:
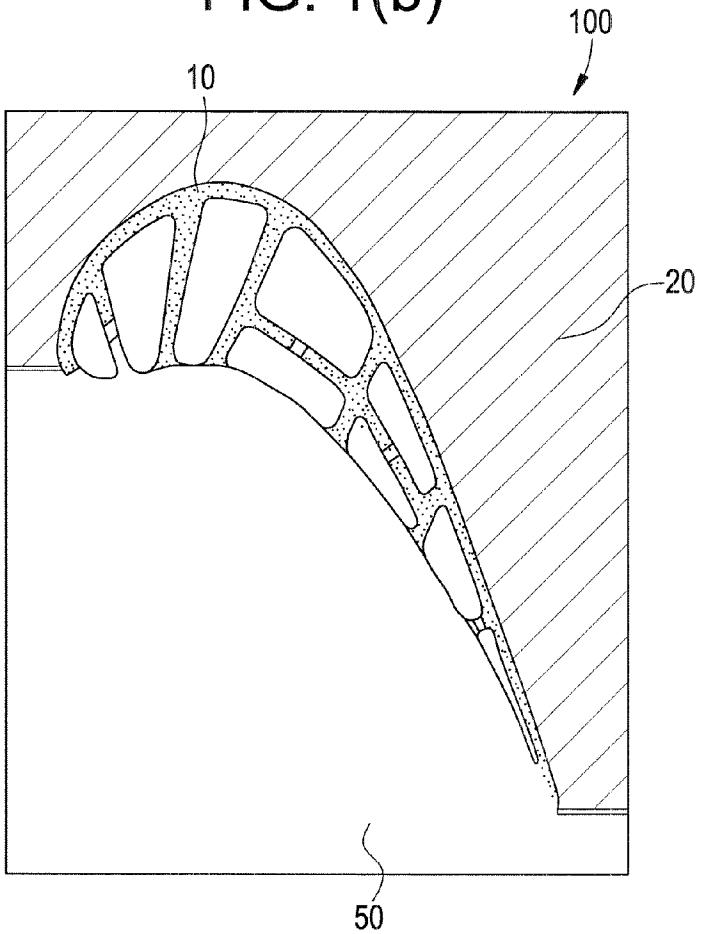
FIG. 1(*a*) depicts one embodiment of an exemplary composite core die that can be used to manufacture a turbine airfoil.

The use of the terms "a" and "an" and "the" and similar references in the context of describing the invention (especially in the context of the following claims) are to be construed to cover both the singular and the plural, unless otherwise indicated herein or clearly contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Disclosed herein is a composite core die that comprises a disposable portion and a reusable portion. In one embodiment, both the disposable portion and the reusable portion both comprise an enforcer. The enforcer provides mechanical support to the disposable portion and the reusable portion during the casting and curing of a ceramic slurry. The disposable portion (hereinafter the 'disposable core die') and the reusable portion (hereinafter the 'reusable core die') can be used cooperatively with each other to produce a ceramic core. The ceramic core can then be used to produce a desired casting of a component such as, for example, a turbine airfoil. Castings produced by this method have better dimensional tolerances than those produced by other commercially utilized processes.

In one embodiment, the method comprises disposing a slurry that comprises a ceramic into the composite die. The slurry generally comprises particles of a ceramic that upon firing solidify to form a solidified ceramic core whose shape and volume is substantially identical with the internal shape and volume of the composite die. The slurry upon being disposed in the interstices and channels of the composite die is then cured to form a cured ceramic core. Upon curing of the slurry, the reusable core die along with the optional corresponding enforcer are removed. The reusable core die and the corresponding enforcer are generally manufactured from a metal and can be reused in other molding operations.

The disposable core die along with the optional corresponding enforcer are also removed. The cured ceramic core thus obtained is fired to obtain a solidified ceramic core. The solidified ceramic core is then disposed inside a wax die. The wax die is made from a metal. Wax is injected between the solidified ceramic core and the metal and allowed to cool. The wax die is then removed leaving behind a wax component with the ceramic core enclosed therein. The wax component is then subjected to an investment casting process wherein it is repeatedly immersed into a ceramic slurry to form a ceramic slurry coat whose inner surface corresponds in geometry to the outer surface of the desired component. The wax component disposed inside the ceramic slurry coat is then subjected to a firing process wherein the wax is removed leaving behind a ceramic mold. Molten metal may then be poured into the ceramic mold to create a desired metal component. As noted above, the component can be a turbine component such as, for example, a turbine airfoil.

Figure 1A:
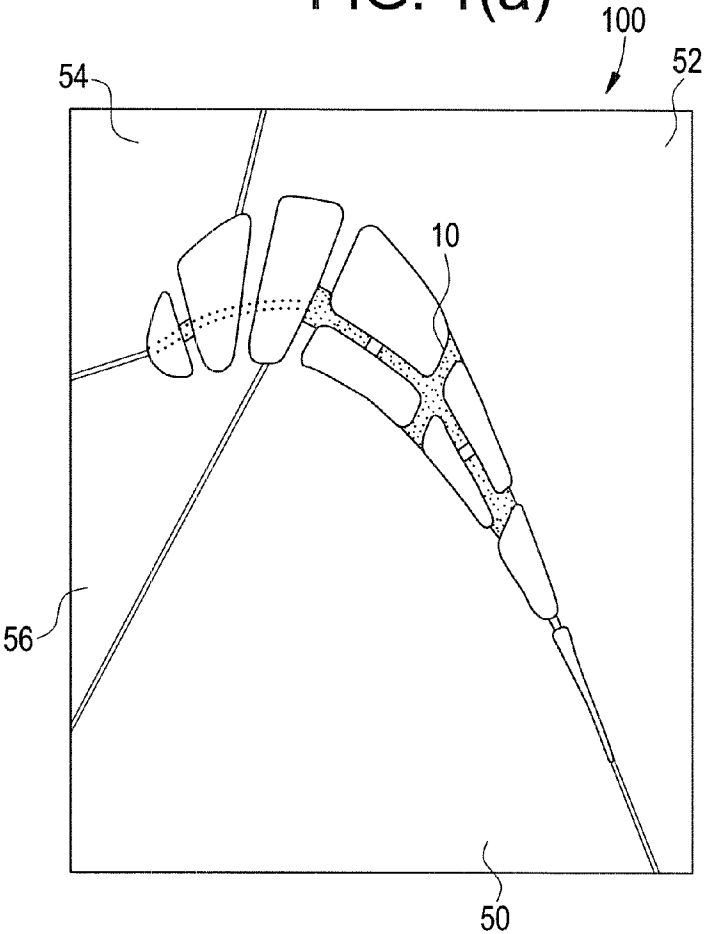

FIG. 1(*a*) depicts one embodiment of an exemplary composite core die 100 that can be used to manufacture a turbine airfoil. As can be seen in the FIG. 1(*a*), the disposable core die 10 is used cooperatively with multiple reusable core dies 50, 52, 54 and 56 to form a composite core die 100. In the FIG. 1(*a*), the disposable core die 10 is used to create internal surfaces of the ceramic core. In one embodiment, in one method of using the composite core die 100 to produce a turbine airfoil, the disposable core die 10 and the reusable core dies 50, 52, 54 and 56 are brought together to intimately contact each other. The points of contact between the disposable core die 10 and the reusable core dies 50, 52, 54 and 56 are arranged to be in a tight fit so as to prevent the leakage of any slurry from the composite core die 100.

FIG. 1(*b*) depicts another exemplary embodiment of a composite die 100 that can be used to manufacture a turbine airfoil. In this embodiment, an optional enforcer 20 is used to provide support for the disposable core die 10. In this embodiment, the disposable core die 10 is used to create an external surface of the ceramic core.

As can be seen from the FIG. 1(*b*), the enforcer has contours that match the external contour of the disposable core die to provide the necessary mechanical support for the disposable core die during the ceramic core injection. While only the disposable core die 10 is provided with an enforcer 20, it is indeed possible to have the reusable core die 50 also be supported by a second enforcer (not shown).

Figure 2:
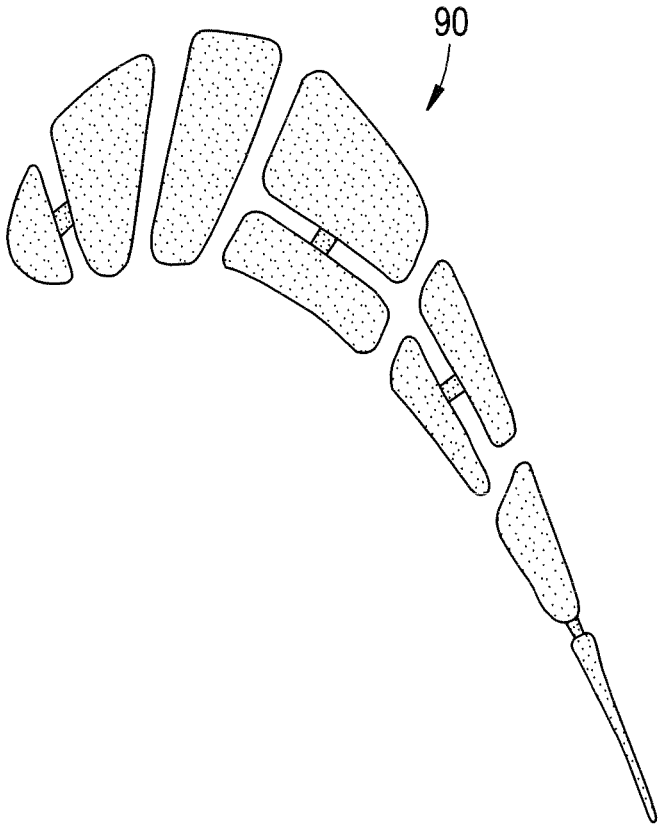
FIG. 2 depicts a cured ceramic core after being fired to form a solidified ceramic core.

As noted above, a slurry comprising ceramic particles is then introduced into the interstices and channels of the composite core die 100. Details of the slurry can be found in U.S. application Ser. Nos. 10/675,374 (now U.S. Pat. No. 7,287,573) and 11/256,823, the entire contents of which are hereby incorporated by reference. After the ceramic core is formed, the reusable core die 50 (or the multiple reusable core dies 50, 52, 54 and 56) are removed along with the optional enforcer 20. The slurry is then subjected to curing to form the cured ceramic core. The disposable core die 10 along is also removed to leave behind the cured ceramic core depicted in the FIG. 2. FIG. 2 depicts the cured ceramic core after being fired to form a solidified ceramic core 90. The disposable core die may be removed using chemical, thermal, mechanical methods or a combination comprising at least one of the foregoing methods. Examples of such methods include chemical dissolution, chemical degradation, mechanical abrasion, melting, thermal degradation or a combination comprising at least one of the foregoing methods of removing.

The ceramic core is then subjected to firing at a temperature of about 1000 to about 1700° C. depending on the core composition to form the solidified ceramic core 90. An exemplary temperature for the firing is about 1090 to about 1150° C.

Figure 3:
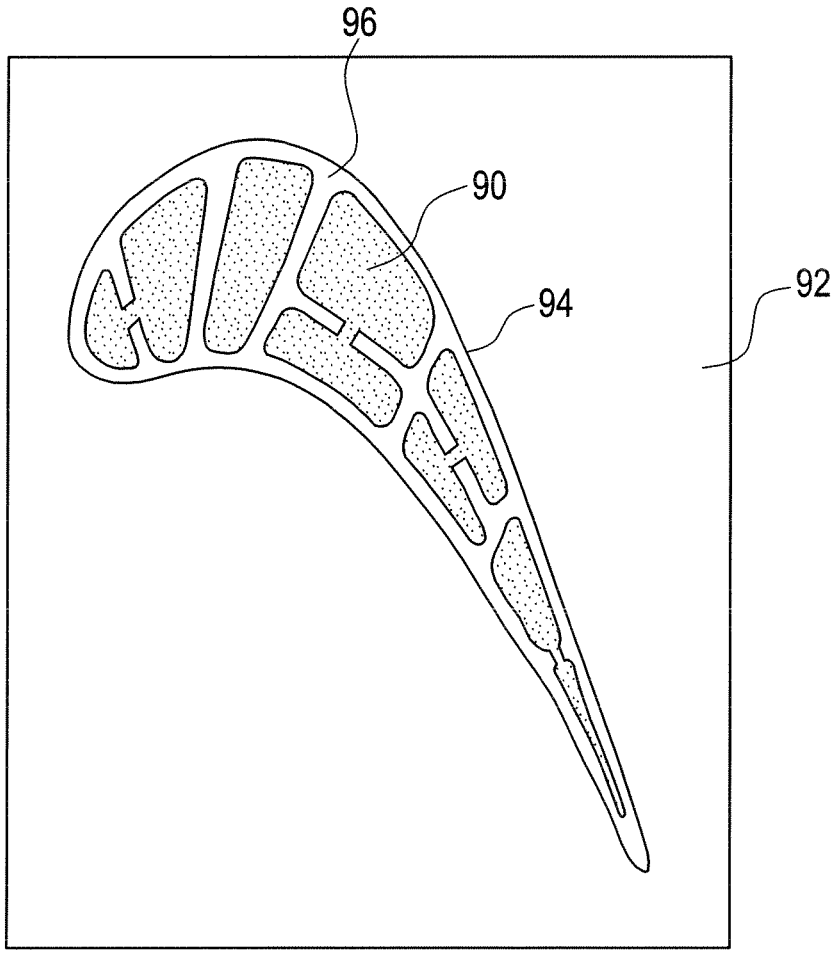
FIG. 3 depicts a wax die that includes the solidified ceramic core.
Figure 4:
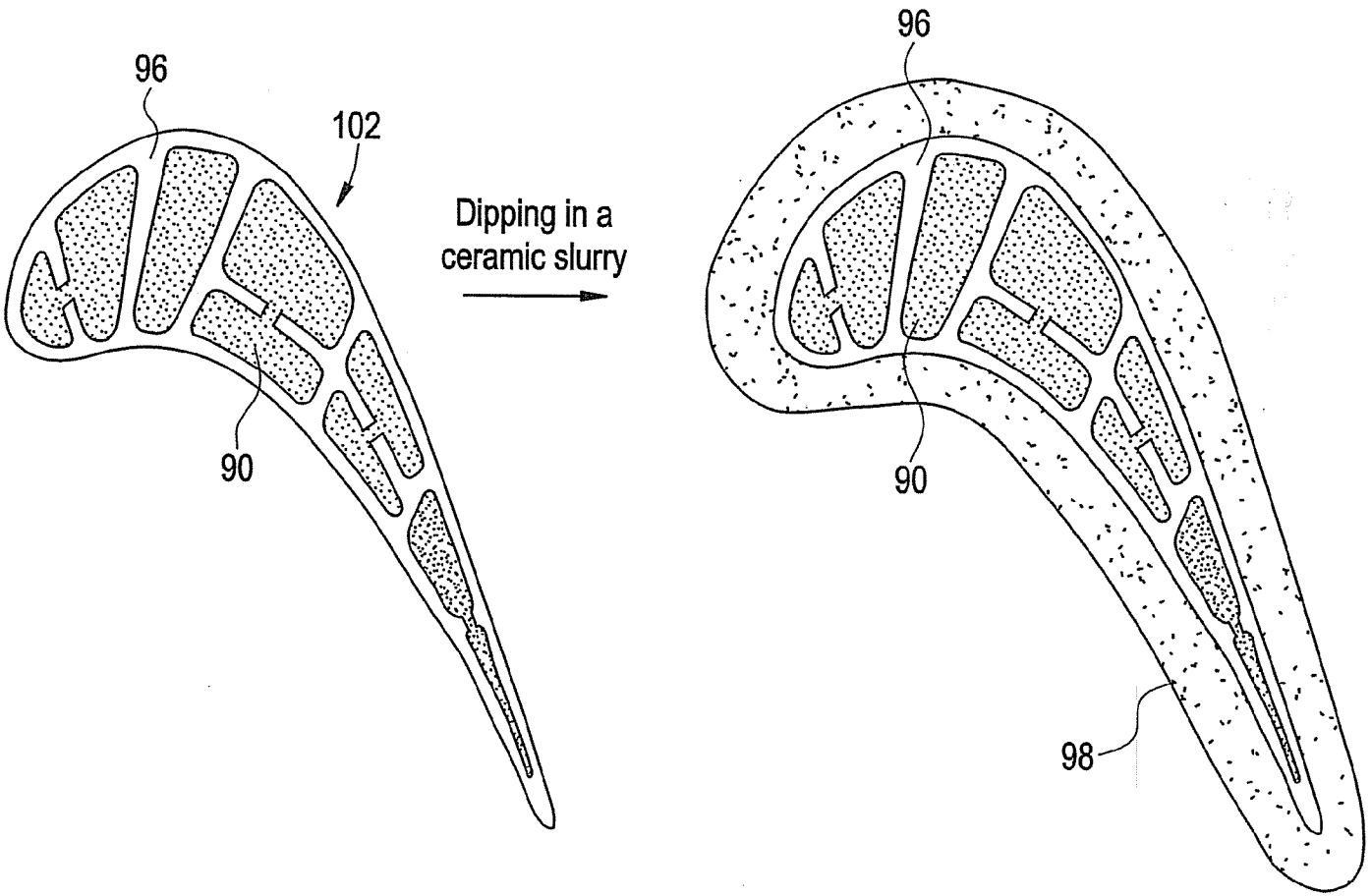
FIG. 4 depicts a ceramic shell created by the immersion of a wax airfoil in a ceramic slurry.
Figure 5:
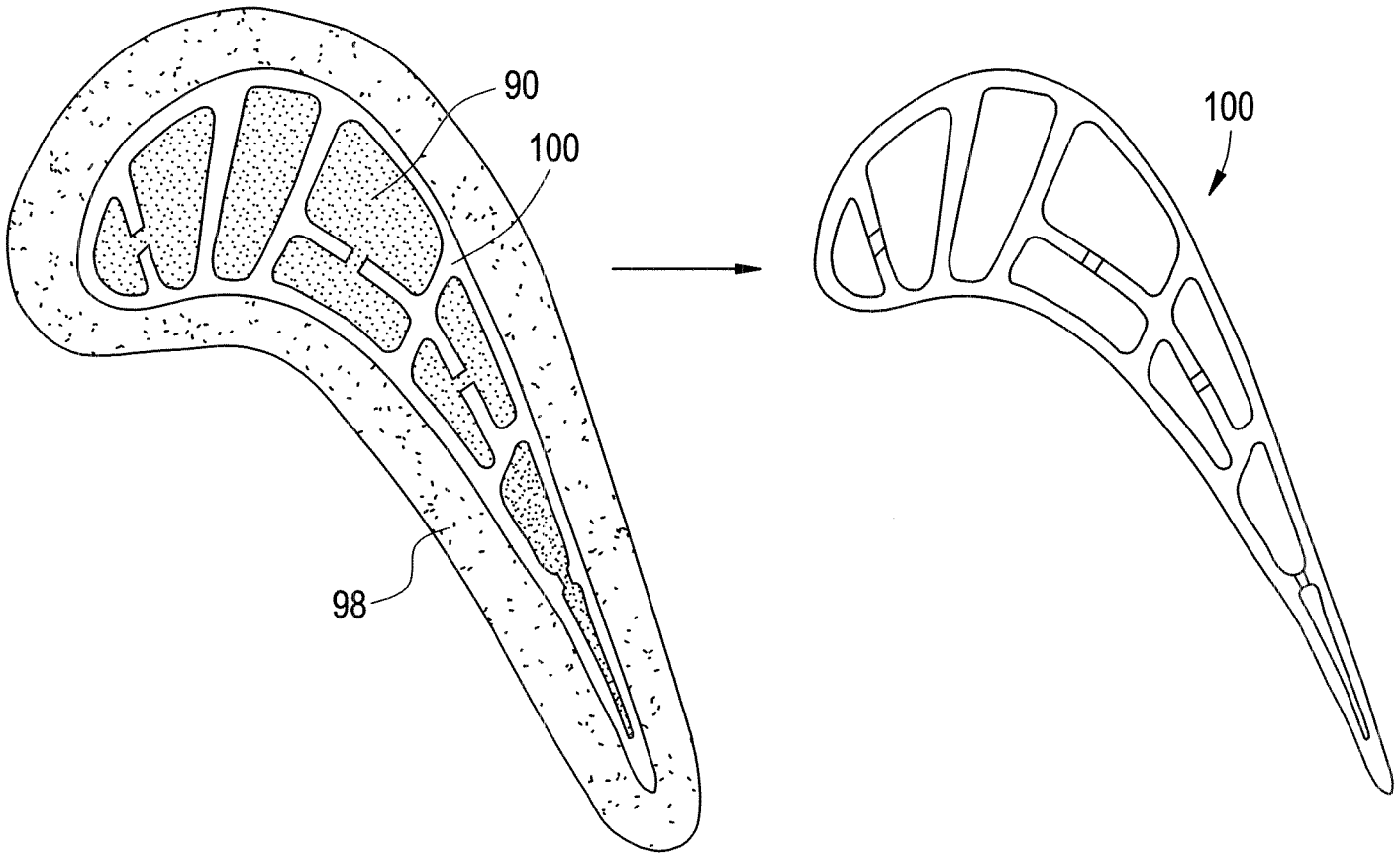
FIG. 5 is an exemplary depiction showing the airfoil (molded component) after removal of the ceramic shell and the integral casting core.

With reference now to the FIG. 3, the solidified ceramic core 90 is then inserted into a wax die 92. The wax die 92 has an inner surface 94 that corresponds to the desired outer surface of the turbine airfoil. Molten wax 96 is then poured into the wax die as shown in the FIG. 3. Upon solidification of the wax, the wax airfoil 102 shown in the FIG. 4 is removed from the wax die 92 and repeatedly immersed in a ceramic slurry to create a ceramic shell 98. The wax present in the wax airfoil 102 is then removed by melting it and permitting it to flow out of the ceramic shell 98 that comprises the solidified ceramic core 90. After the wax is removed, a molten metal may be poured into the ceramic shell 98 that comprises the solidified ceramic core 90. In an exemplary embodiment, a molten metal is poured into the ceramic shell 98 to form the airfoil as depicted in the FIG. 5. FIG. 5 shows the ceramic shell 98 after the molten metal is disposed in it. Following the cooling and solidification of the metal, the ceramic shell 98 is broken to remove the desired airfoil. The solidified ceramic core is then removed from the desired airfoil via chemical leaching.

As noted above the reusable core die and the enforcer are generally manufactured from a metal or a ceramic. Suitable metals are steel, aluminum, magnesium, or the like, or a combination comprising at least one of the foregoing metals. If desired, the reusable core die can also be manufactured via a rapid prototyping process and can involve the use of polymeric materials. Suitable examples of polymeric materials that can be used in the reusable core die and the disposable core dies are described below.

The reusable core die is generally the die of choice for the production of surfaces having intricate features such as bumps, grooves, or the like, that require higher precision. In one embodiment, a single reusable core die can be used for producing the ceramic core in a single molding step. In another embodiment, a plurality of reusable core dies can be used in a single molding step if desired.

Figure 6B:
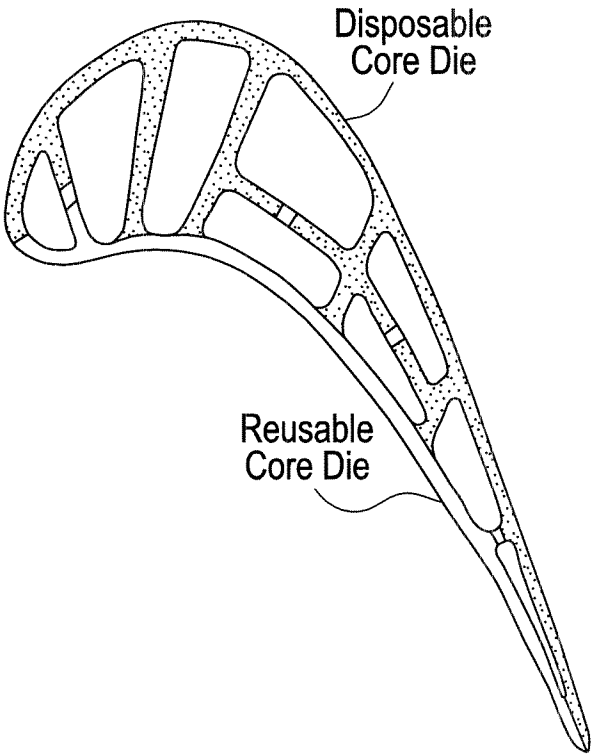
FIGS. 6(*a*) and (*b*) depict various configurations wherein a disposable core die and a reusable core die can be combined to create a composite core die.
Figure 6A:
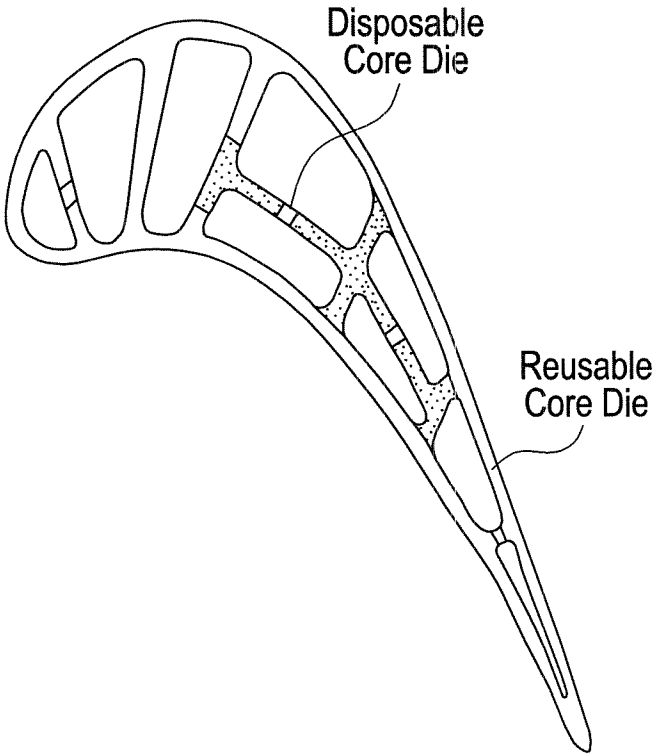

With reference now to the FIGS. 6(*a*) and (*b*), it can be seen that the reusable core die is generally used as an external portion of the composite core die. In other words, an internal surface of the reusable core die forms the external surface of the core.

As can be seen in the FIG. 6(*b*), the composite core die may comprise a reusable core die that forms only a partial portion of the external surface of the core die. Alternatively, as depicted in the FIG. 6(*a*), the composite core die may comprise a reusable core die that forms the complete external surface of the composite core die. Once the slurry is injected into the composite core die and cured, the reusable core die is mechanically removed.

The disposable core die is in physical communication with the reusable core die in the composite core die. It is desirable for the points and surfaces of communication between the disposable core die and the reusable core die to serve as barriers to the flow of the slurry that is eventually solidified into a ceramic core.

The disposable core die can be removed prior to or after the reusable core die is removed. In an exemplary embodiment, the disposable core die is removed only after the reusable core die is removed. As noted above, it can be removed by chemical, thermal or mechanical methods. The disposable core is generally a one-piece construction, though if desired, more than one piece can be used in the manufacture of a desired casting.

The disposable core die can be used either for the creation of an internal surface or external surface in the airfoil. Once again, with reference to the FIGS. 6(*a*) and (*b*), it can be seen that the disposable core die may be used as an external portion of the composite core die or as an internal portion of the composite core die.

The disposable core die is generally manufactured from a casting composition that comprises an organic polymer. The organic polymer can be selected from a wide variety of thermoplastic polymers, thermosetting polymers, blends of thermoplastic polymers, or blends of thermoplastic polymers with thermosetting polymers. The organic polymer can comprise a homopolymer, a copolymer such as a star block copolymer, a graft copolymer, an alternating block copolymer or a random copolymer, ionomer, dendrimer, or a combination comprising at least one of the foregoing types of organic polymers. The organic polymer may also be a blend of polymers, copolymers, terpolymers, or the like, or a combination comprising at least one of the foregoing types of organic polymers. The disposable core die is generally manufactured in a rapid prototyping process.

Examples of suitable organic polymers are natural and synthetic waxes and fatty esters, polyacetals, polyolefins, polyesters, polyaramides, polyarylates, polyethersulfones, polyphenylene sulfides, polyetherimides, polytetrafluoroethylenes, polyetherketones, polyether etherketones, polyether ketone ketones, polybenzoxazoles, polyacrylics, polycarbonates, polystyrenes, polyamides, polyamideimides, polyarylates, polyurethanes, polyarylsulfones, polyethersulfones, polyarylene sulfides, polyvinyl chlorides, polysulfones, polyetherimides, or the like, or a combinations comprising at least one of the foregoing polymeric resins.

Blends of organic polymers can be used as well. Examples of suitable blends of organic polymers include acrylonitrile-butadiene styrene, acrylonitrile-butadiene-styrene/nylon, polycarbonate/acrylonitrile-butadiene-styrene, polyphenylene ether/polystyrene, polyphenylene ether/polyamide, polycarbonate/polyester, polyphenylene ether/polyolefin, and combinations comprising at least one of the foregoing blends of organic polymers.

Exemplary organic polymers are acrylonitrile-butadiene styrene (ABS), natural and synthetic waxes and fatty esters, and ultraviolet (UV)) cured acrylates. Examples of suitable synthetic waxes are n-alkanes, ketones, secondary alcohols, beta-diketones, monoesters, primary alcohols, aldehydes, alkanoic acids, dicarboxylic acids, omega-hydroxy acids having about 10 to about 38 carbon atoms. Examples of suitable natural waxes are animal waxes, vegetal waxes, and mineral waxes, or the like, or a combination comprising at least one of the foregoing waxes. Examples of animal waxes are beeswax, Chinese wax (insect wax), Shellac wax, whale spermacetti, lanolin, or the like, or a combination comprising at least one of the foregoing animal waxes. Examples of vegetal waxes are carnauba wax, ouricouri wax, jojoba wax, candelilla wax, Japan wax, rice bran oil, or the like, or a combination comprising at least one of the foregoing waxes. Examples of mineral waxes are ozocerite, Montan wax, or the like, or a combination comprising at least one of the foregoing waxes.

As noted above, the disposable core die can be manufactured from thermosetting or crosslinked polymers such as, for example, UV cured acrylates. Examples of crosslinked polymers include radiation curable or photocurable polymers. Radiation curable compositions comprise a radiation curable material comprising a radiation curable functional group, for example an ethylenically unsaturated group, an epoxide, and the like. Suitable ethylenically unsaturated groups include acrylate, methacrylate, vinyl, allyl, or other ethylenically unsaturated functional groups. As used herein, "(meth)acrylate" is inclusive of both acrylate and methacrylate functional groups. The materials can be in the form of monomers, oligomers, and/or polymers, or mixtures thereof. The materials can also be monofunctional or polyfunctional, for example di-, tri-, tetra-, and higher functional materials. As used herein, mono-, di-, tri-, and tetrafunctional materials refers to compounds having one, two, three, and four radiation curable functional groups, respectively.

Exemplary (meth)acrylates include methyl acrylate, tert-butyl acrylate, neopentyl acrylate, lauryl acrylate, cetyl acrylate, cyclohexyl acrylate, isobornyl acrylate, phenyl acrylate, benzyl acrylate, o-toluyl acrylate, m-toluyl acrylate, p-toluyl acrylate, 2-naphthyl acrylate, 4-butoxycarbonylphenyl acrylate, 2-methoxycarbonylphenyl acrylate, 2-acryloyloxyethyl-2-hydroxypropyl phthalate, 2-hydroxy-3-phenoxypropyl acrylate, ethyl methacrylate, n-butyl methacrylate, sec-butyl methacrylate, isobutyl methacrylate, propyl methacrylate, isopropyl methacrylate, n-stearyl methacrylate, cyclohexyl methacrylate, 4-tert-butylcyclohexyl methacrylate, tetrahydrofurfuryl methacrylate, benzyl methacrylate, phenethyl methacrylate, 2-hydoxyethyl methacrylate, 2-hydroxypropyl methacrylate, glycidyl methacrylate, and the like, or a combination comprising at least one of the foregoing (meth)acrylates.

The organic polymer may also comprise an acrylate monomer copolymerized with another monomer that has an unsaturated bond copolymerizable with the acrylate monomer. Suitable examples of copolymerizable monomers include styrene derivatives, vinyl ester derivatives, N-vinyl derivatives, (meth)acrylate derivatives, (meth)acrylonitrile derivatives, (meth)acrylic acid, maleic anhydride, maleimide derivatives, and the like, or a combination comprising at least one of the foregoing monomers.

An initiator can be added to the casting composition in order to activate polymerization of any monomers present. The initiator may be a free-radical initiator. Examples of suitable free-radical initiators include ammonium persulfate, ammonium persulfate and tetramethylethylenediamine mixtures, sodium persulfate, sodium persulfate and tetramethylethylenediamine mixtures, potassium persulfate, potassium persulfate and tetramethylethylenediamine mixtures, azobis[2-(2-imidazolin-2-yl) propane] HCl (AZIP), and azobis(2-amidinopropane) HCl (AZAP), 4,4'-azo-bis-4-cyanopentanoic acid, azobisisobutyramide, azobisisobutyramidine.2HCl, 2-2'-azo-bis-2-(methylcarboxy)propane, 2-hydroxy-1-[4-(hydroxyethoxy)phenyl]-2-methyl-1-propanone, 2-hydroxy-2-methyl-1-phenyl-1-propanone, or the like, or a combination comprising at least one of the aforementioned free-radical initiators. Some additives or comonomers can also initiate polymerization, in which case a separate initiator may not be desired. The initiator can control the reaction in addition to initiating it. The initiator is used in amounts of about 0.005 wt % and about 0.5 wt %, based on the weight of the casting composition.

Other initiator systems, in addition to free-radical initiator systems, can also be used in the casting composition. These include ultraviolet (UV), x-ray, gamma-ray, electron beam, or other forms of radiation, which could serve as suitable polymerization initiators. The initiators may be added to the casting composition either during the manufacture of the casting composition or just prior to casting.

Dispersants, flocculants, and suspending agents can also be optionally added to the casting composition to control the flow behavior of the composition. Dispersants make the composition flow more readily, flocculants make the composition flow less readily, and suspending agents prevent particles from settling out of composition.

As noted above, the ceramic core (manufactured from the composite core die) may be further used for molding metal castings. In one exemplary embodiment, the disposable core dies may be used for manufacturing turbine components. These turbine components can be used in either power generation turbines such as gas turbines, hydroelectric generation turbines, steam turbines, or the like, or they may be turbines that are used to facilitate propulsion in aircraft, locomotives, or ships. Examples of turbine components that may be manufactured using disposable core dies are stationary and/or rotating airfoils. Examples of other turbine components that may be manufactured using disposable core dies are seals, shrouds, splitters, or the like.

Disposable core dies have a number of advantages. They can be mass produced and used in casting operations for the manufacture of turbine airfoils. The disposable core die can be manufactured in simple or complex shapes and mass produced at a low cost. The use of a disposable core die can facilitate the production of the ceramic core without added assembly or manufacturing. The use of a disposable core die can eliminate the use of core assembly for producing turbine airfoils. In addition, the use of the reusable core die in conjunction with the disposable core die can facilitate a reduction in the volume of disposable core dies. This results in a reduction in the cost of rapid prototyping materials along with a reduction in manufacturing process time.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A composite core die comprising:

a reusable core die; and a disposable core die; wherein the disposable core die is in physical communication with the reusable core die; and further wherein surfaces of communication between the disposable core die and the reusable core die serve as barriers to prevent a leakage of a slurry that is disposed in the composite core die, the leakage being prevented between the surfaces of the disposable core die and the reusable core die that contact one another; wherein the reusable core die and the disposable core die are not parts of a ceramic core; the ceramic core defining a surface of an airfoil.

2. The composite core die of claim 1, further comprising an enforcer that serves as a support for either the reusable core die, the disposable core die, or both the reusable core die and the disposable core die.

3. The composite core die of claim 1, wherein the reusable core die comprises a metal surface.

4. The composite core die of claim 1, comprising a plurality of reusable core dies.

5. The composite core die of claim 1, wherein the reusable core die forms an external wall of the composite core die.

6. The composite core die of claim 1, comprising a reusable core die that forms a partial portion of the external wall of the composite core die.

7. The composite core die of claim 1, comprising a reusable core die that forms the complete external wall of the composite core die.

8. The composite core die of claim 1, wherein the reusable core die and the disposable core die both comprise an organic polymer.

9. The composite core die of claim 8, wherein the organic polymer is a thermoplastic polymer, a thermosetting polymer, a blend of thermoplastic polymers, or a blend of thermoplastic polymers with thermosetting polymers.

10. The composite core die of claim 8, wherein the organic polymer is a homopolymer, a copolymer, a star block copolymer, a graft copolymer, an alternating block copolymer, a random copolymer, ionomer, dendrimer, or a combination comprising at least one of the foregoing types of organic polymers.

11. The composite core die of claim 1, wherein the disposable core die comprises acrylonitrile-butadiene styrene, natural waxes, synthetic waxes, fatty esters, ultraviolet (UV) cured acrylates, or a combination comprising at least one of the foregoing.

* * * * *